United States Patent [19]

Bixler et al.

[11] Patent Number: 4,582,248

[45] Date of Patent: Apr. 15, 1986

[54] UPWARDLY MOLDED LOCKING FLANGE ON CARTON

[75] Inventors: Kenneth D. Bixler, Huntington; Donald C. McCann, Pittsford; Robert E. Ralphs, Katonah, all of N.Y.; Henry A. Lord, Cape Elizabeth, Me.; Richard F. Reifers, New Caanan, Conn.

[73] Assignee: Packaging Corporation of America, Evanston, Ill.

[21] Appl. No.: 659,168

[22] Filed: Oct. 9, 1984

Related U.S. Application Data

[63] Continuation of Ser. No. 513,191, Jul. 13, 1983, abandoned, which is a continuation-in-part of Ser. No. 436,203, Oct. 22, 1982, abandoned.

[51] Int. Cl.[4] ..... B65D 85/32

[52] U.S. Cl. ..... 229/45 EC; 229/2.5 R; 229/44 R; 229/44 EC

[58] Field of Search ..... 229/44 EC, 45 EC, 44 R, 229/2.5 EC, 2.5 R; 217/26.5; 220/306, 339; D9/425; 493/913; 264/320, 321, 322, 163; 162/228, 231

[56] References Cited

U.S. PATENT DOCUMENTS

| | | | |
|---|---|---|---|
| 3,028,065 | 4/1962 | Reifers | 229/2.5 EC |
| 3,034,693 | 5/1962 | Cox | 229/45 EC |
| 3,144,973 | 8/1964 | Heintzelman | 229/2.5 EC |
| 3,215,327 | 11/1965 | Crabtree | 229/2.5 EC |
| 3,398,875 | 8/1968 | Snow et al. | 229/44 EC |
| 3,459,360 | 8/1969 | Bagay | 229/44 EC |
| 3,501,083 | 3/1970 | Lake | 229/45 EC |
| 3,506,182 | 4/1970 | Snow et al. | 229/45 EC |
| 3,567,107 | 3/1971 | Artz | 229/44 EC |
| 3,645,436 | 2/1972 | Boyd et al. | 229/44 EC |
| 3,661,320 | 5/1972 | Donaldson | 229/44 EC |
| 3,664,574 | 5/1972 | Pearl et al. | 229/44 EC |
| 3,670,952 | 6/1972 | Venuti et al. | 229/44 EC |
| 3,813,027 | 5/1974 | Misdom, Jr. et al. | 229/45 EC |
| 4,081,123 | 3/1978 | Reifers | 229/2.5 EC |

FOREIGN PATENT DOCUMENTS

| | | | |
|---|---|---|---|
| 705727 | 3/1965 | Canada | 229/45 EC |
| 68351 | 8/1969 | German Democratic Rep. | 220/339 |
| 7704274 | 10/1978 | Netherlands | 229/44 EC |
| 2023888 | 5/1980 | United Kingdom | 229/44 EC |

*Primary Examiner*—William Price
*Assistant Examiner*—Gary E. Elkins
*Attorney, Agent, or Firm*—Neuman, Williams, Anderson & Olson

[57] ABSTRACT

A molded carton is provided having a lock system for retaining a cover section in an overlying closed relation with the open top of a base section. The lock system includes a hinged flange mounted on a front segment of the base sections defining the open top. The flange is mounted for limited inward pivotal movement from a normal upright position wherein the flange projects generally upwardly from the front of the base section. The flange is provided with a predetermined number of outwardly projecting protrusions which, when the cover section is in closed position, interlockingly engage a corresponding number of apertures formed in the front wall of the cover section.

14 Claims, 12 Drawing Figures

FIG. 3
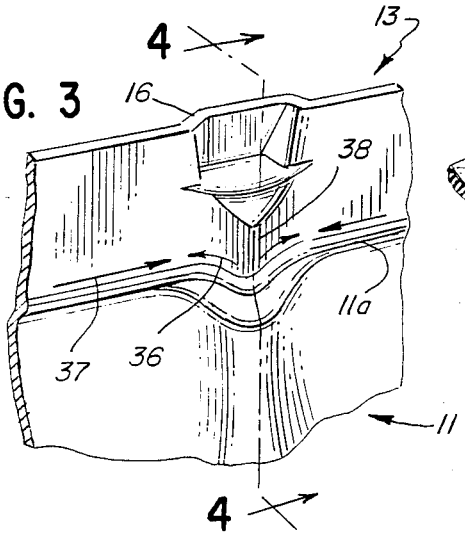
FIG. 8
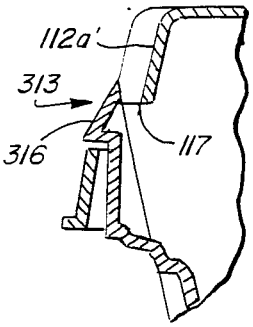
FIG. 9
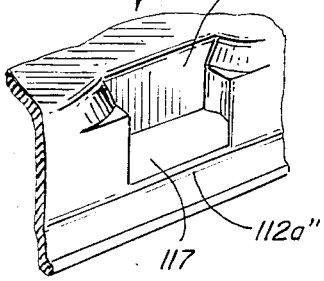
FIG. 7A
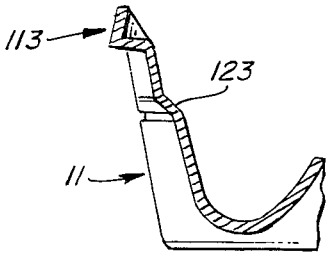
FIG. 7B
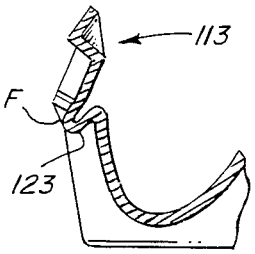
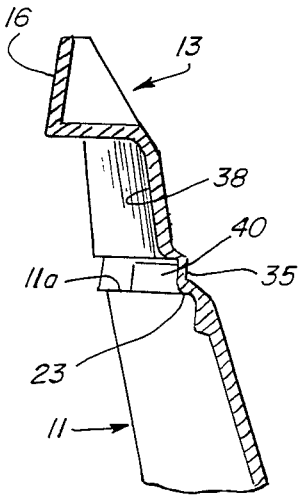
FIG. 4
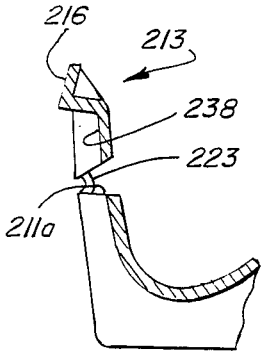
FIG. 7C
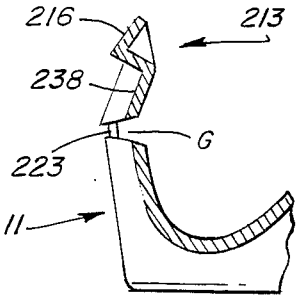
FIG. 7D

UPWARDLY MOLDED LOCKING FLANGE ON CARTONcl BACKGROUND OF THE INVENTION

This is a Continuation of a Continuation in Part application Ser. No. 513,191 filed July 13, 1983 now abandoned, of a parent application Ser. No. 436,203 filed Oct. 22, 1982 now abandoned.

The invention relates to a moldable and nestable carton for accommodating a plurality of fragile articles, such as eggs or the like. The carton includes an article-accommodating tray section, a cover section hingedly connected to one side thereof, and a lock system for securely maintaining the cover section in a closed position relative to the tray section while the loaded carton is being subjected to normal handling.

Various prior cartons of this general type have heretofore been utilized; however, because of certain inherent design characteristics they have been beset with one or more of the following shortcomings: (a) the lock system incorporates a locking flange which is molded in a laterally extended position relative to one side of the tray section thereby requiring a molding platen of substantial width and breath; (b) where the locking flange is molded in a laterally extended position, such a carton, when nested with similar cartons for storage or shipment in bulk, will occupy a substantial area; (c) the configuration of the projections on the locking flange with respect to the configuration of the lock openings in the cover is such that a secure locking engagement can not be readily attained; (d) the components of the lock system are fragile and susceptible to tearing or deformation; (e) locking and unlocking of the cover oftentimes subjects certain of the accommodated articles to an inordinate amount of pressure or displacement resulting in one or more articles being damaged or cracked thereby rendering the loaded carton unmerchantable; and (f) the carton is incapable of providing adequate protection for the accommodated articles and/or causes the lock system to accidently assume an unlocked mode when similar loaded cartons are arranged in stacked relation for display or storage purposes.

SUMMARY OF THE INVENTION

Thus, it is an object of the invention to provide an improved molded carton which avoids the aforenoted shortcomings of the prior art.

It is a further object to provide an improved molded carton which may be readily formed of molded pulp or plastic material.

It is a further object to provide an improved molded carton wherein the flange of the lock system is molded in such a relative position with respect to the carton tray section, that the molding platen for each carton occupies a smaller amount of space in a molding machine of conventional size and thus, the number of molding platens can be increased with a corresponding increase in productivity per machine hour.

It is still a further object to provide a molded carton with an improved lock system wherein the locking flange thereof readily assumes a position which is less susceptible to damage when said carton is nested with a plurality of other like cartons.

It is still a further object to provide a molded carton with an improved lock system whereby the cover of the carton may be readily manipulated into a lock mode with the carton tray section by a high speed automatic closing apparatus.

Further and additional objects will appear from the description, attached drawings and appended claims.

DESCRIPTION

For a more complete understanding of the invention reference should be made to the drawings wherein:

FIG. 3 is an enlarged fragmentary perspective interior view of the locking flange of FIG. 2.

FIG. 4 is an enlarged fragmentary sectional view of the locking flange taken along line IV—IV of FIG. 3.

FIGS. 7A–7B are sectional views similar to FIG. 4 and showing, respectively, a modified locking flange in its generally upwardly extending normal position, and in an inwardly pivoted locking position with respect to the cover section.

FIGS. 7C–7D are sectional views similar to FIGS. 7A–7B, but of a further modified embodiment of the locking . flange.

FIG. 8 is a fragmentary sectional view similar to FIG. 6 but showing a third modified embodiment of the locking flange in engagement with a modified complemental lock opening formed in the cover section front wall.

FIG. 9 is a fragmentary perspective view of the front wall opening shown in FIG. 8.

Figure 1:
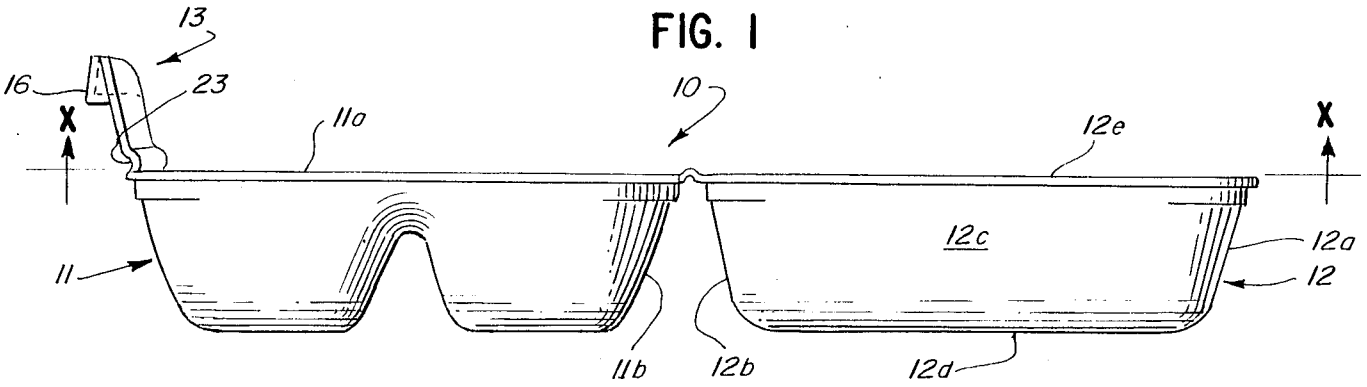
FIG. 1 is an end elevational view of a molded carton embodying one form of the improved lock system; the carton being shown in a fully open position ready for loading.
Figure 6:
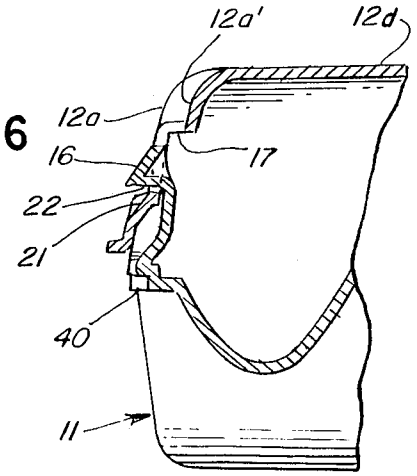
FIG. 6 is an enlarged fragmentary sectional view of the improved lock system taken along lines VI—VI of FIGS. 2 and 5 and showing the cover section locked in a closed position with respect to the tray section.

Referring now to the drawings and more particularly to FIG. 1, a preferred embodiment of an improved lock system is shown incorporated in a molded carton 10 intended to accommodate a plurality of fragile articles (e.g. eggs). The carton is of one piece construction and is molded from paper pulp, foam plastic or similar material on a large molding machine commonly utilized in the commercial production of such cartons. While the description to follow is directed to an egg carton, the lock system incorporated therein is not intended to be limited thereto.

Carton 10 includes a cellular tray or base section 11 which is provided with one or more rows of egg receiving cells arranged in parallel relation with each row normally including six cells. The open top of the base section is substantially delineated by a peripheral flange or rim 11*a*. Hingedly connected to an elongated rear segment of the rim is a cover section 12 which, when in a closed position, is in a substantially superimposed overlying relation with the open top of the tray section and thus, retains the eggs within the cells. The cover section includes an apertured front wall 12*a*, a rear wall 12*b*, and end walls 12*c* which delimit and project from a top panel 12*d*. The side 12*e* opposite the top panel 12*d* is open. When the carton 10 is molded the cover section 12 is laterally disposed relative to rear side 11*b* of the tray section 11 and, as shown in the illustrated embodiment, the open top defined by the rim 11*a* of the tray section and the open side 12*e* of the cover section 12 are disposed in a common horizontal plane X—X. In other instances, however, the open top 12*e* of the base section may be recessed from plane X—X. Mounted on an elongated front segment of the rim 11*a* for limited inward hinged movement is a locking flange 13 molded so as to assume a normal upright position extending generally upwardly from the common plane X—X, see FIG. 1. As will be described more fully hereinafter, the locking flange 13 has a predetermined number of laterally spaced protrusions 16 formed thereon which extend through and interlock with complemental openings 17 formed in the cover section front wall 12*a* and retain the cover section in a closed position. The front wall openings 17 will be described more fully hereinafter.

The carton, as shown in FIG. 1, is in the form it assumes (a) when removed from the molding machine; (b) when being assembled in nested relation with other like cartons for either bulk storage or shipment to the customer; or (c) when being loaded with eggs. A predetermined number of cartons are normally nested together to form a bundle which in turn is overwrapped with a suitable protective material before being stored or shipped to the customer. When the cartons are to be loaded utilizing conventional high speed automatic loading equipment, a stack of nested cartons is removed from the bundle and placed in a suitable hopper, and then individual cartons are denested or removed therefrom and positioned at a predetermined egg loading station. Such an operating procedure is well known in the art.

Because the locking flange 13 is molded in the normal upright position rather than in a laterally extending position as is the case in numerous prior art cartons, the area defined by the periphery of each nested carton 10 is substantially reduced with the result that the space occupied by a bundle formed of a predetermined number of improved cartons is smaller than normal thereby enabling a greater number of bundles to be accommodated in a given space.

A further advantage of having the locking flange molded in the normal upright position is that in a molding machine having a predetermined width (e.g. 66 inches) the number of molding platens or mold cavities arranged across the width of the machine can be increased by approximately 20–25% with the hourly productivity of the machine at a given speed being significantly increased with a resultant savings in manufacturing costs.

Figure 2:
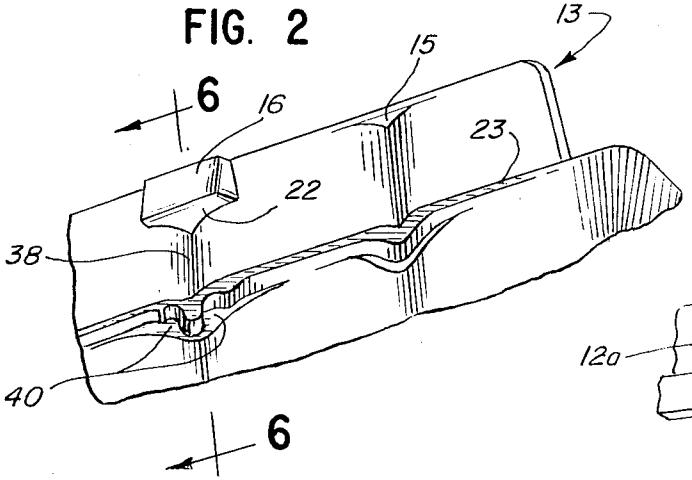
FIG. 2 is an enlarged fragmentary perspective exterior view of the locking flange per se shown in FIG. 1 attached to the front edge of the tray section.

The locking flange 13 has an elongated configuration and, as seen in FIG. 2, may have one or more inwardly offset portions 15 formed along its top edge so as to enhance the rigidity thereof. Spaced longitudinally from the offsets 15 and disposed along the upper edge of flange 13 are a plurality of the outwardly extending lock protrusions 16. The number of protrusions will depend upon the length of the carton. Normally in a carton wherein there are six cells per row and two rows formed in the tray section 11, two longitudinally spaced protrusions 16 are utilized. It is preferred that each protrusion be aligned with a transverse plane which extends between adjoining cells in the row adjacent the flange. When the cover section 12 is moved to a closed position, see FIG. 6, the flange 13 will be disposed behind the cover section front wall and each protrusion 16 will extend outwardly through and positively interlock with a lock opening 17 formed in the front wall. To provide added stiffness to the flange 13 and to increase the area of the underside 22 of each protrusion 16, which is engageable with a peripheral portion 21 of the opening, a furrow or elongated depression 38 is formed in the exterior surface of flange 13, see FIG. 2. Each furrow extends transversely upwardly from the flange hinge line 23 to the underside 22 of the protrusion. In order to enable the front wall 12*a* of the cover section to be disposed in front of the locking flange and in face-to-face relation therewith it is necessary for the flange 13 to be pivoted inwardly a small amount (e.g. not in excess of 40°) about the hinge line 23 so that the protrusions 16 will initially slide past the backside of the front wall 12*a* until the protrusions are aligned with the corresponding openings 17 whereupon the flange will automatically pivot forwardly seeking to return to its normal upright position but before reaching the normal position, it will positively engage the interior surface or backside of the cover section front wall 12*a* causing the protrusions to project outwardly through and interlock with the respective cover section openings. Several versions of the hinge line formation are illustrated in FIGS. 2, 4, 6 and 7A–D.

To open the carton so as to gain access to the accommodated eggs, the customer with the fingers of one hand manually depresses one protrusion while simultaneously distorting outwardly and upwardly the lower edge portion of the cover front wall until the protrusion clears the lower indented peripheral portion 21 of the corresponding lock opening 17 while the tray section 11 of the carton is supported by the other hand of the customer. The same manipulation is repeated with the remaining protrusion(s). By reason of the indentation 21 and the enlarged area of the protrusion underside 22, the cover is able to attain a secure hold on the protrusions see FIG. 6. It will be noted in FIG. 5, that the portion 12*a* of the front wall deposed above the lock opening 17 is recessed, thus providing greater accessibility for manually depressing the protrusion to effect unlocking of the cover section 12.

FIG. 4 shows in cross-section one locking flange 13 in its normal upright position and hingedly connected to the front edge of the tray section rim by a thin segment 35 that extends substantially around the indentation 38 as designated by dimension lines 36 in FIG. 3.

The remainder of the hinge line 23 is formed by a relatively thin web of material and includes substantially rectilinear segments designated by dimension lines 37 which are separated from one another by indented segments designated by dimension line 36. The indented hinge line segments are aligned with the indentations or furrow 38 formed in the exterior surface of the flange 13. As observed in FIG. 2, a pair of nubs or pad-like elements 40 are formed at each designated indented segment 36 in close proximity and beneath the web defining said hinge segment. The function of each pair of nubs is to restrict the inward pivoting of the flange from its normal upright position to not more than about forty degrees (40°). Thus, as the flange is pivoted inwardly a portion of the underside of the indentation 38 will yieldably abut the upper surface of each nub 40 and the latter will resist further inward pivoting and provide a resilient reactive force urging the flange to pivot outwardly and engage the interior surface of the cover front wall. Because the protrusion 16 is disposed between adjoining cells in the adjacent row of cells, inward pivoting of the flange so as to disengage the protrusion from the cover section opening results in a minimal amount of force being exerted on any of the articles (eggs) accommodated in the adjacent rows of cells.

FIGS. 7A and 7B disclose a modified flange 113 wherein the web defining the hinged line 123 is inclined outwardly a slight amount so that when the flange is pivoted inwardly the web will become distorted and form a resilient bellows-like fold F, see FIG. 7B.

FIGS. 7C–D show a further modified form of locking flange 213 wherein the underside of the furrow 238 is not connected to the front segment of the rim 211*a* of the carton tray section and thus, a gap G is formed therebetween. The portions of flange 213 disposed on opposite sides of the furrow 238 are connected to the rim 211*a* by longitudinally spaced portions of the hinge line 223.

Figure 5:
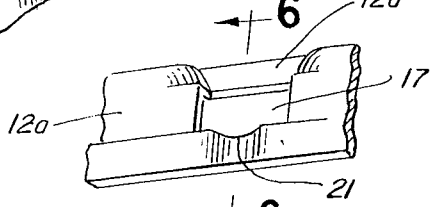
FIG. 5 is a fragmentary perspective exterior view of the front wall of the cover section showing one of the lock openings formed therein.

FIG. 9 shows a slightly modified cover section 112 wherein the height of the lock opening 117 formed in the cover section front wall 112*a* is reduced and the portion 112*a'* of the front wall is recessed a greater amount than is the case with cover section 12, shown in FIG. 5. The portion 112*a''* of the front wall disposed beneath the opening 117 may be rectilinear as shown or provided with an indentation 21, if desired. A modified locking flange 313 shown in FIG. 8 coacts with the opening 117 to securely lock the cover in a closed position. The protrusions 316 formed in flange 313 have a slightly greater height than the corresponding dimension of the openings 117 whereby when the protrusions are interlocking with the cover openings, the upper end of each protrusion will project slightly above the opening and thus, prevents the protrusion from pivoting inwardly enough to effect accidental unlocking of the cover section. Thus, in order to effect opening of the cover section, it is necessary that the cover front wall portion 112*a''* be manually distorted outwardly so as to be lifted clear of protrusion 316.

Thus, a molded carton has been described which embodies a simple yet effective lock system. The components of the lock system may be readily molded into the carton in such a way that the productivity of a conventional molding apparatus at a given speed of operation can be significantly improved. Furthermore, a greater number of improved cartons when in nested relation can be stored in a given space than would be the case with the same number of cartons having laterally extending lock components.

We claim:

1. A molded carton comprising a base section having an open top; a cover section adapted to overlie and close said open top, said cover section including a rear wall, an apertured front wall, and end walls coacting to form an open side; and a lock system for locking the cover section in said overlying closed relation, said lock system including a hinged flange molded and mounted in an upright position on a front segment of the base section defining the open top for limited inward pivotal movement from the normal molded upright position wherein said flange projects generally upwardly from the front of the base section, a front surface of the flange being provided with a predetermined number of protrusions projecting through and interlocking with a corresponding number of apertures formed in the cover section front wall when said flange is pivoted inwardly from said normal upright position and resiliently engages an interior surface of the cover section front wall when said cover section overlies and closes the base section open top.

2. The carton of claim 1 wherein a portion of the flange front surface disposed beneath at least one protrusion is recessed and the base section is provided with means in close proximity to and beneath the flange recessed portion for engaging the underside thereof and limit inward hinged movement of the flange from its normal molded upright position, the means, when engaging the flange recessed portion, imparting a reactive force on said flange urging same against the cover section front wall and effecting interlocking engagement between the predetermined number of flange protrusions and the corresponding apertures of the cover section front wall.

3. The carton of claim 1 wherein the cover section is hingedly connected to a rear segment of the base section defining the open top, said cover section being molded in a laterally offset position relative to the base section open top, and the lock system flange being molded on the front segment of the base section open top so as to normally project generally upwardly from a plane defined by the front and rear segments of the base section open top.

4. The carton of claim 1 wherein portions of the cover section front wall disposed above the apertures formed therein are recessed to the remainder of said front wall.

5. The carton of claim 2 wherein the means on said base section substantially limits inward pivoting of the lock system flange to about 40° from its normal upright position.

6. The carton of claim 1 wherein the protrusions are formed adjacent an upper edge of the flange and the portions of the flange disposed beneath the protrusions are recessed.

7. The carton of claim 4 wherein the protrusions of the flange, when in interlocking relation with the cover section front wall apertures, have segments thereof extending above the peripheries of said apertures.

8. The carton of claim 6 wherein the recessed portions of the flange beneath the protrusions are connected to the front segment of the base section by web portions which define in part the hinge line of the flange.

9. The carton of claim 6 wherein the flange hinge line is interrupted by gaps disposed in aligned relation with the recessed portions of the flange.

10. A locking system for a molded carton such as an egg carton having a base section and a cover section hingedly connected thereto, said system comprising a lock flange attached to an edge of the base section opposite from the cover section and molded to normally project upwardly; a hinge portion at the juncture of the base section and the flange; a lock protrusion on said flange; a lock opening in the cover section positioned to receive said lock protrusion; and means on the base section for producing a force on said flange to keep said protrusion engaged in said lock opening when the cover section is overlying the base section.

11. A molded and nestable egg carton including a locking system, said molded and nestable egg carton comprising a cellular base for receiving and holding a plurality of eggs; a cover hingedly connected to said base; a lock flange attached to the opposite edge of said base from said cover and being molded to normally assume an upwardly projecting configuration and being withdrawable from a mold in which it is formed; a lock protrusion on said lock flange; a lock opening in said cover positioned to receive said lock protrusion; and a non-linear scalloped hinge along the juncture of said base and flange, said hinge permitting rotation of said lock flange only inwardly a maximum of about 40°, said scalloped hinge including means to produce a force including a compressive force on said lock flange to keep said lock protrusion engaged in said lock opening.

12. The egg carton of claim 11, further characterized by said lock opening leaving an indent on the lower lip of said lock opening engaging with said lock protrusion.

13. The egg carton of claim 11, further characterized by the front wall of the cover having a wall extending upwardly from the lock opening, said wall being spaced inwardly of the remainder of the front wall of said cover so that said wall above the opening is recessed, the height of the opening being less than the height of said lock protrusion, whereby when the carton is locked the upper part of the lock protrusion extends above and in front of the bottom of said recessed wall above the lock opening.

14. The egg carton of claim 11, wherein said means to produce a force on said lock flange to keep said lock protrusion engaged in said lock opening, includes semi-cylindrical abutment forms at the top of said base and under said lock flange adjacent said scalloped hinge, whereby, as the upper part of said flange rotates inwardly, said scalloped hinge becomes forced against said semi-cylindrical abutment forms thereby creating a spring return action on said flange which in turn causes resistance against further inward movement of said flange.

* * * * *